United States Patent [19]

Anguiano

[11] 4,095,391

[45] Jun. 20, 1978

[54] APPARATUS FOR BUNCHING BROCCOLI

[75] Inventor: Benjamin E. Anguiano, Aptos, Calif.

[73] Assignee: Veg-A-Mix, Castroville, Calif.

[21] Appl. No.: 799,507

[22] Filed: May 23, 1977

[51] Int. Cl.[2] ..... B65B 27/10; B65B 67/00; B26D 7/28

[52] U.S. Cl. ..... 53/123; 53/390; 83/409.2

[58] Field of Search ..... 53/123, 390; 83/409.2, 83/435.2

[56] References Cited

U.S. PATENT DOCUMENTS

| | | | |
|---|---|---|---|
| 2,319,900 | 5/1943 | De Back | 53/123 X |
| 3,123,958 | 3/1964 | Carruthers | 53/123 |

*Primary Examiner*—Travis S. McGehee

*Attorney, Agent, or Firm*—Boone, Schatzel, Hamrick & Knudsen

[57] ABSTRACT

An improved broccoli bunching apparatus for expediting the bunching, tying and trimming of broccoli and including a plurality of buckets, which are driven around a first endless loop, each bucket having a head supporting portion for supporting the heads of a bunch of broccoli and a U-shaped stalk support for supporting the broccoli stalks and for carrying a tie band, a plurality of U-shaped clamps which are driven in synchronization with the buckets around a second endless loop disposed above and behind the stalk supports, each clamp for compressingly holding a bunch of broccoli stalks against a corresponding stalk support and a saw disposed to trim the stalks of broccoli clamped between a stalk support and a corresponding clamp.

18 Claims, 2 Drawing Figures

APPARATUS FOR BUNCHING BROCCOLI

BACKGROUND OF THE INVENTION

1. Field of the Invention

The present invention relates generally to food bunching devices and more particularly to an improved apparatus for use in the bunching, trimming and tying of broccoli.

2. Description of the Prior Art

Bunching of irregularly shaped foodstuffs, such as broccoli, has presented many problems in the past. Bunching and tying by hand in the field is a slow and thus expensive process. In an effort to partially automate the process, hydraulically operated machines have been employed at individual work stations to grip and trim the broccoli. Although improving the speed somewhat, the knives employed have substantially increased the danger to the workers.

Another prior art apparatus for expediting the handling of broccoli is described in the U.S. Pat. application of David L. Gularte, No. 708,498, entitled "Apparatus for Bunching Broccoli and a Method Therefor," filed July 26, 1976. The apparatus disclosed includes cup-like bins for supporting the heads of bunches of broccoli. Mounted on the front of each bin are two pivotally mounted arms. The first arm is held open by a return spring, and the second arm is held open by an overcenter spring connected to the first arm. The bins are carried around an endless loop by a motor driven chain.

After an operator loads a bind with broccoli, the bin is driven over a plate which engages the first arm in a camming action. The camming action and the overcenter spring cause the arms to close over the stems of the broccoli holding them in place while first a saw trims the ends and then a worker places a band over the stalks. The problem with such apparatus is that the camming action contributes greatly to the noise of the machinery and causes wear and fatigue of the parts. Also, the pivoting arms and springs are likely to catch and pinch the worker's fingers.

SUMMARY OF THE PRESENT INVENTION

It is therefore an object of the present invention to provide an improved apparatus for bunching broccoli which grips the broccoli without the use of cams and springs.

Another object of the present invention is to provide a simpler bunching apparatus having a minimum number of moving parts.

A further object is to provide a bunching apparatus which expedites the handling of broccoli.

Still another object is to provide a bunching apparatus which expedites the tying of broccoli stalks.

Briefly, the preferred embodiment includes a plurality of buckets, which are driven around a first endless loop, the buckets each having a head carrying portion for supporting the heads of a bunch of broccoli and a U-shaped stalk support for supporting the stalks of the broccoli and for carrying an elastic tie band, a plurality of U-shaped clamps which are driven around a second loop, the bottom of which is disposed above the first loop just behind the stalk supports and is caused to move in aligned relation thereto such that each clamp compressingly engages the stalks of a bunch of broccoli against a corresponding stalk support, and a saw disposed to trim the clamped stalks to proper length.

The expeditious handling of broccoli is therefore an important advantage of the present invention.

Another advantage of the present invention is its simplicity.

Still another advantage of the present invention is the improvement in noise level, wear and safety achieved by not utilizing springs loaded arms and cams to grip the broccoli.

These and other objects and advantages of the present invention will no doubt become apparent to those skilled in the art after having read the following detailed description of the preferred embodiment which is illustrated in the several figures of the drawing.

IN THE DRAWING

FIG. 1 is a side elevation view of an improved broccoli bunching apparatus is accordance with the present invention; and FIG. 2 is a perspective view of one of the broccoli buckets shown in FIG. 1.

DESCRIPTION OF THE PREFERRED EMBODIMENT

Figure 1:
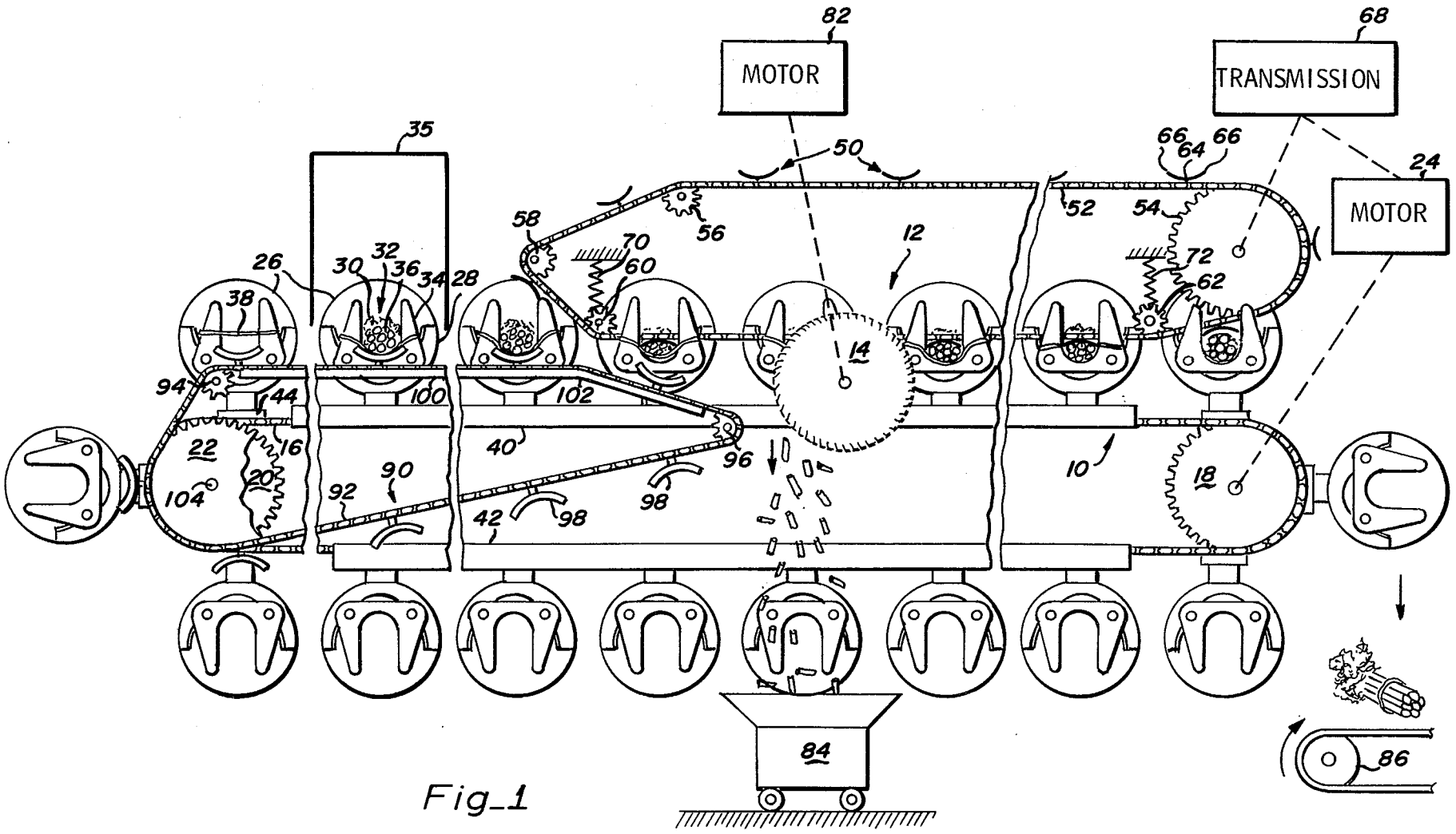

Referring to FIG. 1, the preferred embodiment of an improved broccoli bunching apparatus is shown to generally comprise two endless loops 10 and 12, and a saw 14. Loop 10 includes a chain 16 trained over two sprockets 18 and 20. The sprocket 20 is obscurred by similar sprocket 22. Sprocket 16 is coupled by conventional means to a motor, illustrated diagrammatically at 24, which drives the chain in a clockwise direction. The chain carries a plurality of broccoli carrying buckets 26 which are discussed in detail below. The general, the buckets have a head supporting portion 28 for supporting and holding the heads 30 of a bunch of broccoli 32. Attached to the front of the cup-shaped stalk support 34. The stalk support is suitable for supporting and holding the stalks 36 of the broccoli and for receiving an elastic tie band 38. The buckets are supported and guided throughout most of their travel by two pairs of angle iron guide rails 40 and 42 positioned to support the front and rear ends of the base portion 44 of the buckets.

Loop 12 includes a plurality of C-shaped clamping members 50 carried by a chain 52 trained over six sprockets 54, 56, 58, 50, 61 and 62. The clamps 50 are formed by a bowed rod 64 which is attached at its center to chain 52. The rod ends have pliable tubular outer coverings 66 slipped over them to reduce the likelihood of damaging the broccoli. Loop 12 is disposed above loop 10 and just behind stalk supports 34. Sprocket 54 is similar to sprocket 18 and is coupled to motor 24 through a transmission, shown diagrammatically at 68. The transmission causes sprocket 54 to rotate at the same rate as sprocket 18, but in a counterclockwise direction. Thus, during the lower portion of their travel, clamps 50 are caused to move in an aligned relation with stalk supports 34. Three springs 70, 71 and 72 urge sprockets 60, 61 and 62 downwardly toward loop 10 such that as the clamps 50 move along the bottom of loop 12 they are caused to clampingly engage the broccoli stalks 36 against the stalk supports 34.

Saw 14 is disposed a short distance from the point that the clamp 50 engages the broccoli and is positioned in front of and aligned parallel to stalk supports 34. The lateral position of the saw relative to the track of supports 34 obviously determines the stalk length of the cut broccoli. The saw is coupled by conventional means to a second motor shown diagrammatically at 82. In the preferred embodiment the front of the saw is enclosed in a cage which for a clarity is not shown. A bin 84 is positioned under the saw to catch the broccoli butts as they are cut. A conveyor 86 is disposed below the right most end of loop 10 so as to catch the broccoli bunches after they have been processed, although a second bin could optionally be employed.

An optional third loop 90, disposed in front of loop 10, includes a chain trained over three sprockets 20, 94 and 96. Chain 92 carries a plurality of U-shaped butt supports 98 which have a semicylindrical shape, conforming generally to the shape of the lower portion of the stalk supports 34. The butt supports are attached at their midpoints to chain 92. Over a portion of the loop, chain 92 is supported by a positioning channel 100 which is aligned at one end with sprocket 94 and at its other end with sprocket 96 so as to align butt supports 98 with the stalk supports 34 to partially support the ends of the broccoli stalks until the stalks are engaged by the clamps 50. At point 102, channel 100 is bent at an acute angle so as to form a ramp which allows the butt supports to disengage the broccoli stalks before they reach saw 14. Sprocket 12 is the same size as sprocket 20 and is mounted to the same shaft 104 so that the chains are thus properly synchronized with each other.

Figure 2:
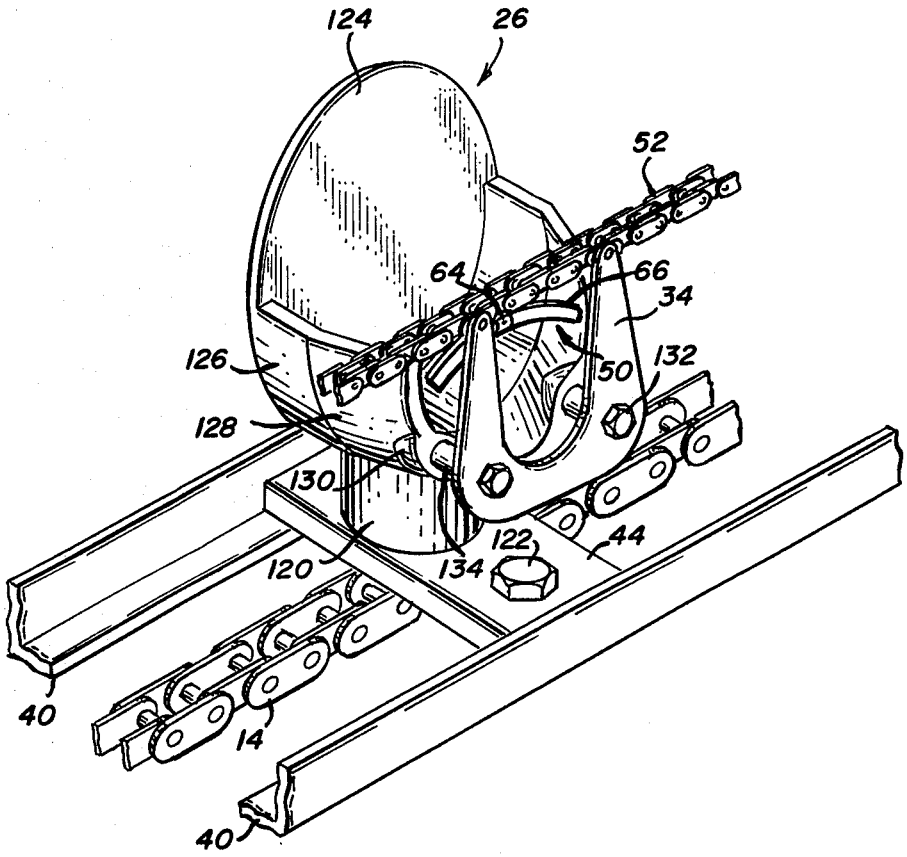

Referring to FIG. 2, the preferred embodiment of a bucket device 26 is shown to include a base 44, a riser 120, a head carrying portion 28 and a stalk support 34. The base 44 is generally rectangular in shape and has two bores provided therein for accommodating two mounting bolts 122. The bolts engage brackets (not shown) which are attached to chain 16 and serve to attach the bucket to the chain. The base is supported throughout most of its travel by two pairs of angle iron guides only the top pair 40 being shown in this Figure.

The head supporting portion 28 is supported above base 44 by riser 120 and is enclosed at the rear by a disk shaped head plate 124. The center of the head supporting portion is semi-cylindrical at 126 tapering in front in frustum fashion at 128. The front edge of the head supporting portion cut away on both sides to provide additional clearance for the clamps 50. The remaining portion of the front edge is provided with bosses 130 having tapped bores which open to the front.

Spaced forward of the head supporting portions at a distance sufficient to both permit passage of the clamps 50 therebetween and to support the stalks of broccoli bunches placed in the bucket, the stalk support 34 is mounted. The stalk support, is generally U-shaped, having an inside radius large enough to receive the stalks of a bunch of broccoli. The upstanding arms of the U-shaped portion provide a means for holding an elastic tie band stretched thereacross. The stalk support is attached by two bolts 132 which pass through bores in the lower portion thereof and through two tubular spacers 134 before being threaded into the bosses 130.

Also shown in FIG. 2 is one of the clamps 50 attached to the chain 52. As previously mentioned, the clamp includes a bowed rod 64 affixed to chain 52 at its midpoint and has two pliable tubular outer coverings 66 disposed over each end. As illustrated the chain and clamp are portioned between the front end of the head supporting portion 28 and the stalk support 34.

In operation, workers are positioned at stations along the travel of loop 10. At a first set of work stations, located proximate sprocket 22, four workers stretch elastic tie bands 38 across the arms of the stalk supports 34. At a second set of work stations, located between the first set and sprocket 58, nine workers place bunches of broccoli into buckets 26. The workers obtain the broccoli from bins 35 disposed behind loop 10 and which are accessible by reaching across the loop. A bunch of broccoli is placed in each bucket with the stalks 36 resting within the corresponding stalk support 34 and butt support 98. More specifically, after the elastic tie band 38 (shown in FIG. 1) is stretched across the arms of a stalk support 34, broccoli is placed in the bucket with the heads of the broccoli resting against the head plate 124 and with the stalks resting across the band and within the stalk support 34. The back plate serves as a reference surface with respect to the saw such that each bunch of broccoli will be uniformly cut to the desired length.

As the loaded buckets proceed along the loop, a clamp 50 of loop 12 compressingly engages the stalks just before the butt supports disengage the broccoli stalks and return around sprocket 96. Saw 80 then cuts the stalks of the broccoli to proper length and the butts fall into bin 84.

Beyond the saw, three workers at the third set of work stations, located between the saw and sprocket 18, lift the fronts of the elastic tie bands 32 over the end of stalks 38 and the top of stalk supports 36 and allow the bands to contract around the stalks of the broccoli. Finally as each bucket rotates around sprocket 20, the broccoli carried thereby, which has not been bunched, cut to length and tied, falls onto conveyor 82.

Although not shown, an adjustable spacing disc, similar to head plate 124, may optionally be positioned within the bucket forward of the head plate. The spacing disc can then be adjusted to vary the lengths to which the broccoli stalks are cut.

Even though a specific embodiment is disclosed other equivalent forms may also be employed. For example, in place of the circular saw other types of saws, such as band saws or reciprocating saws, or other trimming devices, such as knives or hot wires, can also be used. In place of the chain drives cables or rollers may be used to drive the buckets and clamps around all, or only a portion of the loop, such as past the saw. Minor modifications to the stalk supports will permit other tie devices, such as wire ties, to be carried by the supports.

It is contemplated that after having read the preceeding disclosure other alterations and modifications of the present invention will no doubt become apparent to those skilled in the art. It is therefore intended that the following claims be interpreted to cover all such alterations and modifications as fall within the true spirit and scope of the invention.

What is claimed is:

1. Apparatus for bunching, trimming and banding vegetables having a head and a stalk, comprising:

first means forming a first loop extending between a first position and a second position;

vegetable carrying means affixed to said first means at equal intervals so as to be carried around said first loop thereby, said carrying means including a vegetable head-holding portion and vegetable stalk-holding portion, said stalk-holding portion including a pair of upstanding arms forming a stalk receiving slot and adapted to carry banding means stretched thereacross;

second means forming a second loop extending between said second position and a third position intermediate said first and second positions and disposed above said first means, said second means having a plurality of clamping elements affixed thereto at intervals corresponding to the spacing between adjacent one of said carrying means, said second means being positioned relative to said first means such that some of said clamping elements mate with said vegetable carrying means at a point proximate said third position and remain in such mating relationship until the mated carrying means reaches said second position;

first drive means for driving said first and second means in synchronism; and trimming means disposed at a fourth position proximate said third position and between said third position and said second position so as to trim the ends of stalks carried by said carrying means and extending beyond said stalk-holding portion, said fourth position being separated from said second position by a distance long enough to enable the banding means to be removed from said upstanding members and placed about the trimmed ends of the stalks.

2. Apparatus for bunching, trimming and banding vegetables as recited in claim 1 wherein said stalk-holding portion of said carrying means is spaced from said head-holding portion, and wherein said second means is aligned relative to said first means such that said clamping elements mate with said carrying means in the space separating said head-holding portion and said stalk-holding portion.

3. Apparatus for bunching, trimming and banding vegetables as recited in claim 2 wherein said clamping elements are in the form of generally C-shaped rods having their midpoints affixed to said second means and their extremities extending outwardly away from said second means.

4. Apparatus for bunching, trimming and banding vegetables as recited in claim 1 wherein said trimming means includes a motor driven saw blade aligned relative to said first means so as to trim the stalks of vegetables carried by said carrying means at a predetermined distance from the side of said stalk-holding portion opposite said head-holding portion.

5. Apparatus for bunching, trimming and banding vegetables as recited in claim 1 and further comprising means forming a track for guiding said carrying means as they are moved from said first position to said second position and wherein said carrying means includes means for slideably engaging said track means.

6. Apparatus for bunching, trimming and tying vegetables as recited in claim 1 and further comprising:

third means forming a third loop extending from said first position to a fifth position proximate said third position and having a plurality of support members affixed thereto and spaced therealong at intervals corresponding to the spacing between adjacent ones of said carrying means; and drive means for driving said third means in synchronism with said first means such that said support means are positioned adjacent said stalk support means so as to support the untrimmed stalk ends extending outside of carrying means as said stalks are carried from said first position toward said fifth position.

7. Apparatus for bunching, trimming and banding vegetables as recited in claim 6 wherein said stalk-holding portion of said carrying means is spaced from said head-holding portion, and wherein said second means is aligned relative to said first means such that said clamping elements mate with said carrying means in the space separating said head-holding portion and said stalk-holding portion.

8. Apparatus for bunching, trimming and banding vegetables as recited in claim 7 and further comprising means forming a track for guiding said carrying means as they are moved from said first position to said second position and wherein said carrying means includes means for slidably engaging said track means.

9. Apparatus for bunching, trimming and banding vegetables as recited in claim 8 wherein said clamping elements are in the form of generally C-shaped rods having their midpoints affixed to said second means and their extremities extending outwardly away from said second means.

10. Apparatus for bunching, trimming and banding vegetables as recited in claim 9 wherein said trimming means includes a motor driven saw blade aligned relative to said first means so as to trim the stalks of vegetables carried by said carrying means at a predetermined distance from the side of said stalk-holding portion opposite said head-holding portion.

11. Apparatus for bunching, trimming and banding vegetables having a head and a stalk, comprising:

first means forming a first loop extending between a first position and a second position;

vegetable carrying means affixed to said first means at equal intervals so as to be carried around said first loop thereby, said carrying means including a vegetable head-holding portion and a vegetable stalk-holding portion, said stalk-holding portion including a pair of upstanding arms forming a stalk receiving slot;

second means forming a second loop extending between said second position and a third position intermediate said first and second positions and disposed above said first means, said second means having a plurality of clamping elements affixed thereto at intervals corresponding to the spacing between adjacent ones of said carrying means, said second means being positioned relative to said first means such that some of said clamping elements mate with said vegetable carrying means at a point proximate said third position and remain in such mating relationship until the mated carrying means reaches said second position;

first device means for driving said first and second means in synchronism;

trimming means disposed at a fourth position proximate said third position and between said third position and said second position so as to trim the ends of stalks carried by said carrying means and extending beyond said stalk-holding portion;

third means forming a third loop extending from said first position to a fifth position proximate said third position and having a plurality of support members affixed thereto and spaced therealong at intervals corresponding to the spacing between adjacent ones of said carrying means; and drive means for driving said third means in synchronism with said first means such that said support means are positioned adjacent said stalk support means so as to support the untrimmed stalk ends extending outside of said carrying means as said stalks are carried from said first position toward said fifth position.

12. Apparatus for bunching, trimming and banding vegetables as recited in claim 11 wherein said clamping elements are in the form of generally C-shaped rods having their midpoints affixed to said second means and their extremities extending outwardly away from said second means.

13. Apparatus for bunching, trimming and banding vegetables as recited in claim 11 wherein said trimming means includes a motor driven saw blade aligned relative to said first means so as to trim the stalks of vegetables carried by said carrying means at a predetermined distance from the side of said stalk-holding portion opposite said head-holding portion.

14. Apparatus for bunching, trimming and banding vegetables as recited in claim 11 and further comprising means forming a track for guiding said carrying means as they are moved from said first position to said second position and wherein said carrying means includes means for slideably engaging said track means.

15. Apparatus for bunching, trimming and banding vegetables as recited in claim 11 wherein said stalk-holding portion of said carrying means is spaced from said head-holding portion, and wherein said second means is aligned relative to said first means such that said clamping elements mate with said carrying means in the space separating said head-holding portion and said stalk-holding portion.

16. Apparatus for bunching, trimming and banding vegetables as recited in claim 15 and further comprising means forming a track for guiding said carrying means as they are moved from said first position to said second position and wherein said carrying means includes means for slideably engaging said track means.

17. Apparatus for bunching, trimming and banding vegetables as recited in claim 16 wherein said trimming means includes a motor driven saw blade aligned relative to said first means so as to trim the stalks of vegetables carried by said carrying means at a predetermined distance from the side of said stalk-holding portion opposite said head-holding portion.

18. Apparatus for bunching, trimming and banding vegetables as recited in claim 17 wherein said clamping elements are in the form of generally C-shaped rods having their midpoints affixed to said second means and their extremities extending outwardly away from said second means.

* * * * *